United States Patent [19]

Morris et al.

[11] Patent Number: 5,035,025

[45] Date of Patent: Jul. 30, 1991

[54] TRUNDLE TROLLEY FOR A SLIDING DOOR TRACK ASSEMBLY

[75] Inventors: Jerry R. Morris, South Bend, Ind.; George A. Squires, Madison, Wis.

[73] Assignee: Combo Corporation, Elkhart Lake, Wis.

[21] Appl. No.: 468,923

[22] Filed: Jan. 23, 1990

[51] Int. Cl.[5] ..... A47H 15/00; E05D 15/06

[52] U.S. Cl. ..... 16/97; 16/95 R

[58] Field of Search ..... 16/97, 95 R, 88

[56] References Cited

U.S. PATENT DOCUMENTS 2,322,529 6/1943 Long ..... 16/97
2,783,493 3/1957 Gussack ..... 16/97
3,242,535 3/1966 Ferris ..... 16/95 R
3,793,673 2/1974 Lawrence, Jr. ..... 16/97

*Primary Examiner*—Robert L. Spruill
*Assistant Examiner*—Carmine Cuda
*Attorney, Agent, or Firm*—Foley & Lardner

[57] ABSTRACT

A trundle trolley for supporting a door for sliding movement in a tubular track assembly, the trolley including a roller section and a carriage section pivotally mounted on the roller section, the carriage section including a slot on the lower edge and the door including hanger bolts along the top of the door, one hanger bolt being aligned in the slot in each carriage section. Brackets are provided on each carriage section to capture the bolt in the slot in the carriage section.

5 Claims, 3 Drawing Sheets

TRUNDLE TROLLEY FOR A SLIDING DOOR TRACK ASSEMBLY

BACKGROUND OF THE INVENTION

1. Field of the Invention

The present invention relates to a trundle trolley for supporting a sliding door in a track assembly and more particularly to a trundle trolley that can be mounted in the track assembly independent of the sliding door and attached to the sliding door after mounting in the track assembly.

2. Description of the Prior Art

In U.S. Pat. No. 4,424,605 patented Jan. 10, 1984, entitled "Sliding Door Track Assembly Including A Track Cover And Mounting Support" a sliding door track assembly is disclosed generally of the type contemplated herein. The track assembly is mounted as a unit on a track plank provided on the building wall. The door is suspended from the track by a number of rollers having hanger bolts which are secured to the top of the door. The door is mounted in the track by aligning the rollers with the end of the track and sliding the rollers onto the track by moving the door along the face of the building. This required a full crew in order to lift the door and align it properly with the track assembly so that it can be moved along the track assembly as the rollers are aligned in the track assembly. This can be a very difficult job under high wind conditions since the door must be supported outwardly from the building where it is unprotected from the wind. A full crew was also required in order to lift the door in order to align the rollers in the track assembly.

SUMMARY OF THE INVENTION

The trundle trolleys according to the present invention are individually rolled into the track assembly Hanger bolts are installed in the door leaf at the top of the door while the door is on the ground. The door is then placed against the building wall and each trundle trolley is moved along the track assembly and aligned with a hanger bolt. The bolts are aligned in the trundle trolleys by lifting one end of the door and sliding the hanger bolt into a slot provided in the trundle trolley. The bolt is then locked into the trundle trolley by clamps provided on each end of the trolley.

One of the primary features of the invention is the independent mounting of the trundle trolleys in the track assembly prior to mounting the door on the track assembly which simplifies the mounting procedure.

Another advantage of this mounting arrangement is the ease, speed and safety in hanging a sliding door on a track assembly.

Other principal features and advantages of the invention will become apparent to those skilled in the art upon review of the following detailed description, claims and drawings.

DETAILED DESCRIPTION OF THE DRAWINGS

Figure 1:
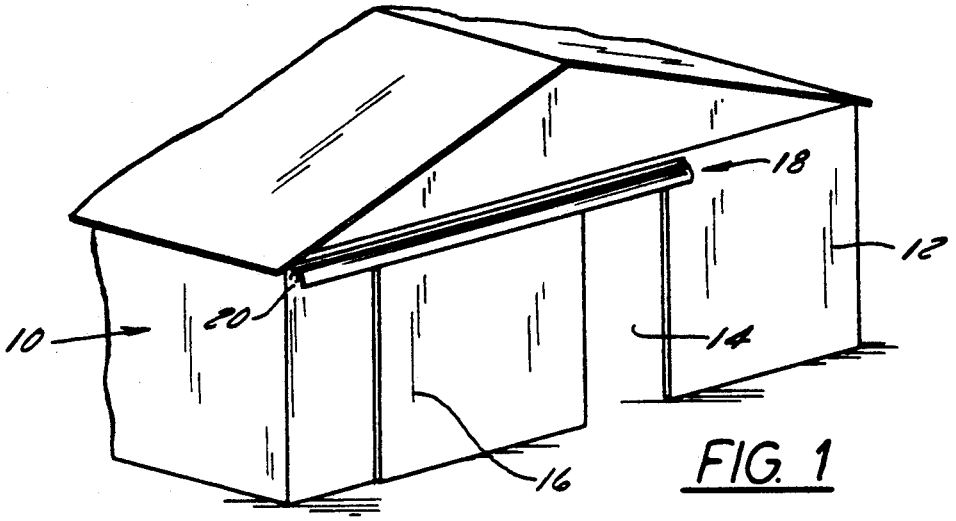
FIG. 1 is a fragmentary perspective view of a typical building structure provided with a sliding door supported by a track assembly according to the present invention.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purposes of description and should not be regarded as limiting.

DETAILED DESCRIPTION OF THE PREFERRED EMBODIMENT

Figure 2:
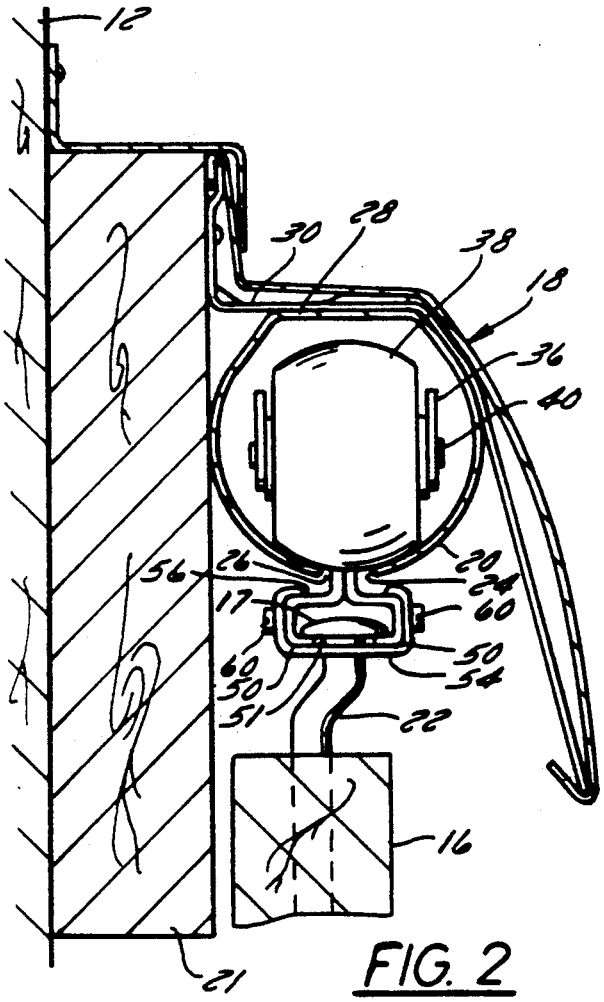
FIG. 2 is an end view of the track assembly shown mounted, on the wall of the building.
Figure 3:
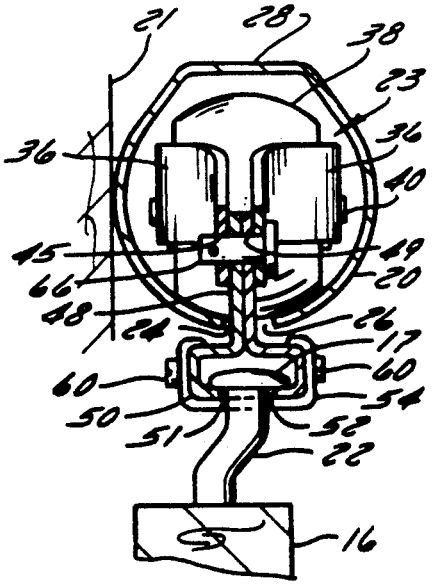
FIG. 3 is a cross-section of the trundle trolley showing the mounting for the hanger bolt on the door.
Figure 4:
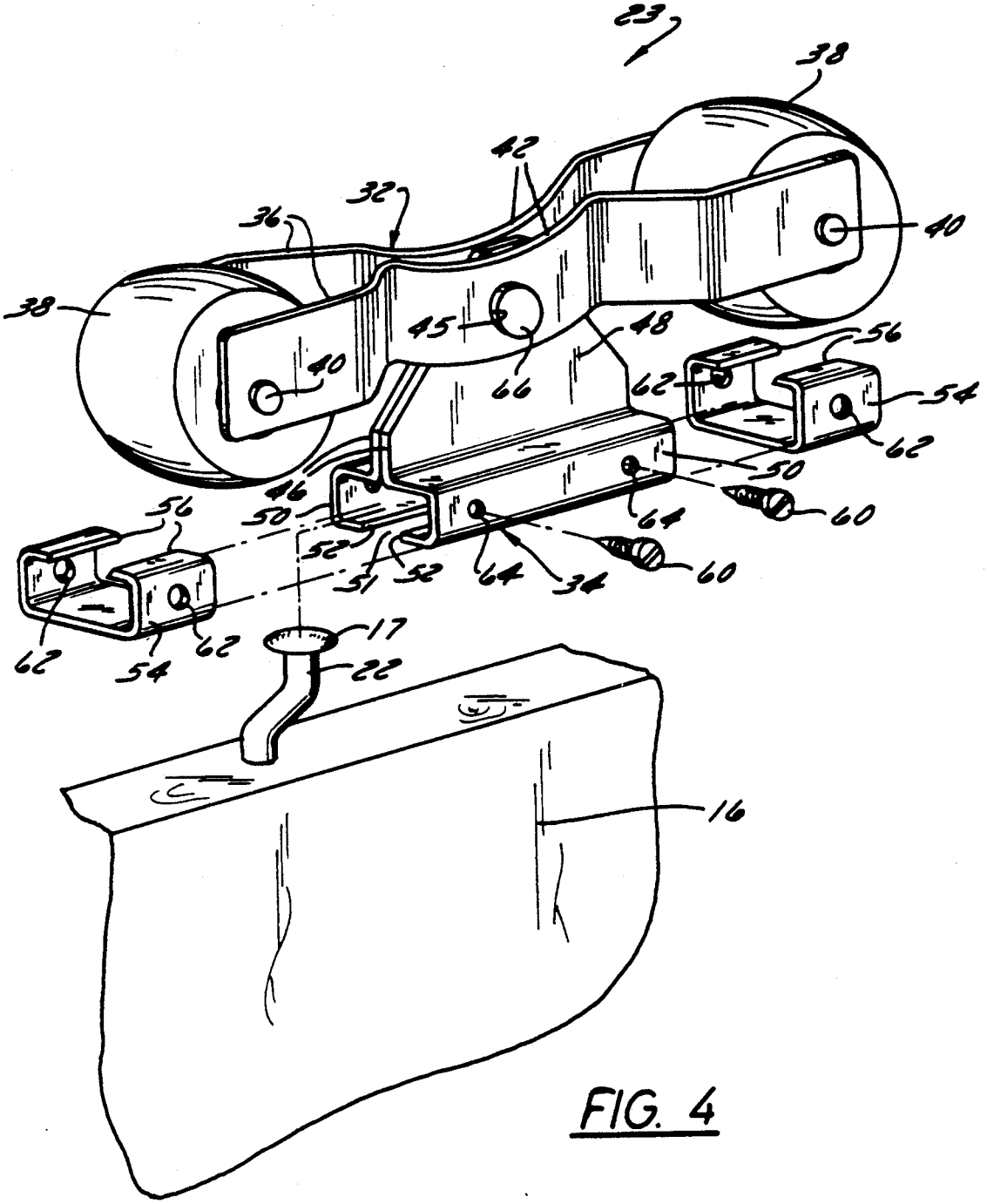
FIG. 4 is an exploded perspective view of the trundle trolley.

Referring to FIG. 1 a building structure of a type which may be used as a barn, garage or industrial storage building as indicated generally at 10. It includes a front wall 12 with a door opening 14. A door 16 is shown supported on a sliding door track assembly 18. The door opening 14 is opened or closed by sliding movement of the door 16 across the face of the building. As seen in FIG. 2, the door 16 is suspended from the track assembly 18 by means of hanger bolts 22 secured to the leaf at the top of the door. The hanger bolts are of the type which can be rotated through 180, in order to adjust the spacing of the door from the face of the building wall.

The track assembly 18 as seen in FIG. 2 generally includes a track 20 which is mounted on the door plank 21 by means of brackets 30. The track 20 is in the form of a hollow tube having a generally circular configuration with the lower edges 24 of the track located at a spaced interval to define a slot 26. The track 20 also includes a flat section 28 on the top to provide a rigid support for the mounting brackets 30.

A trundle trolley 23 according to the present invention is shown in FIGS. 2 through 6. The trolley generally includes a roller section 32 and a carriage section 34. The roller section 32 is formed by means of a pair of plates 36 and a pair of rollers 38. The rollers are supported on each end of the plates 36 by means of axles 40. It should be noted that the roller surfaces have a curved configuration which corresponds to the circular configuration of the track 20. Each of the plates 36 is provided with an arcuate section 42 having a hole 45 intermediate the ends thereof.

In this regard the carriage 34 is formed by means of a pair of plates 46. Each of the plates includes a flat support section 48 and a C-shaped box section 50. A hole 49 is provided in each of the support sections 48. The bottom edges 52 of the box sections 50 are spaced apart to form a slot 51 to accommodate the hanger bolt 22. The hanger bolt 22 is captured in the slot 51 by means of brackets 54 which are mounted on the ends of the box sections 50 of the carriage 34. Each bracket 54 includes a pair of flanges 56 which overlie the top of the box sections 50 to support the brackets on the box sections. The brackets 54 are secured to the carriage by means of bolts 60 which pass through holes 62 in the brackets and are screwed into threaded holes 64 provided in the sections 50. One bracket 54 is mounted on the carriage section before the trundle trolley is mounted in track assembly 18.

Means are provided for pivotally mounting the carriage section 34 on the roller section 32. This allows the carriage section to pivot with respect to the roller section as the hanger bolts are mounted in the trundle trolleys. Such means can be in the form of a pin 66 which passes through the hole 45 in the plates 36 and hole 49 in the plates 46.

Figure 5:
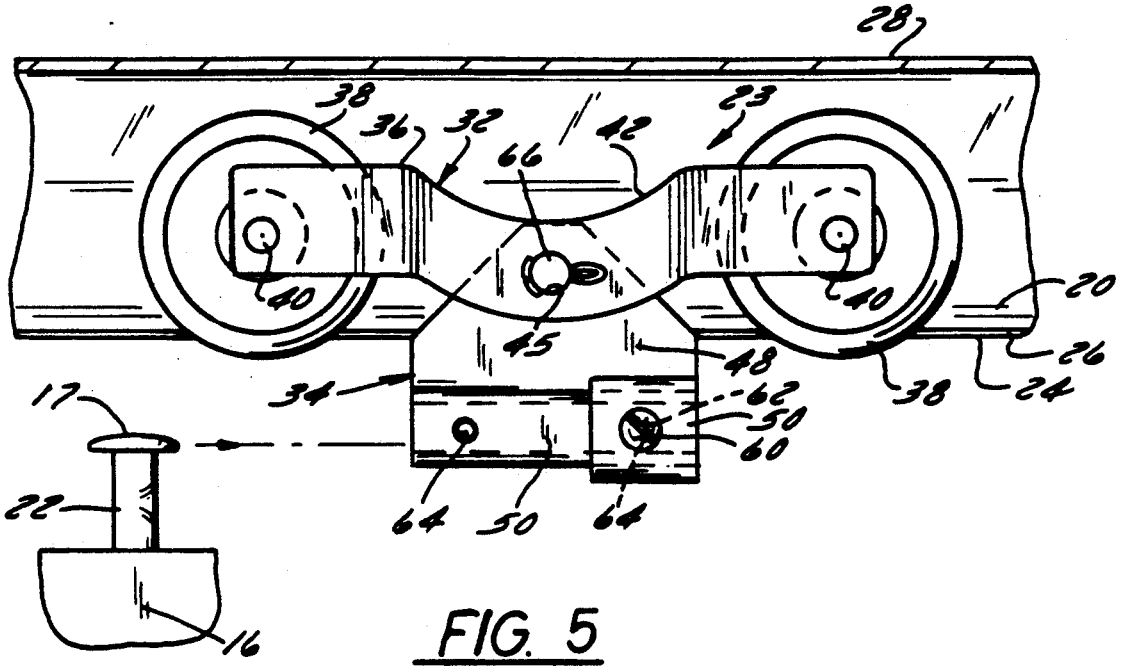
FIG. 5 is a view similar to FIG. 6, showing the hanger bolt for the door positioned for insertion into the trundle trolley.
Figure 6:
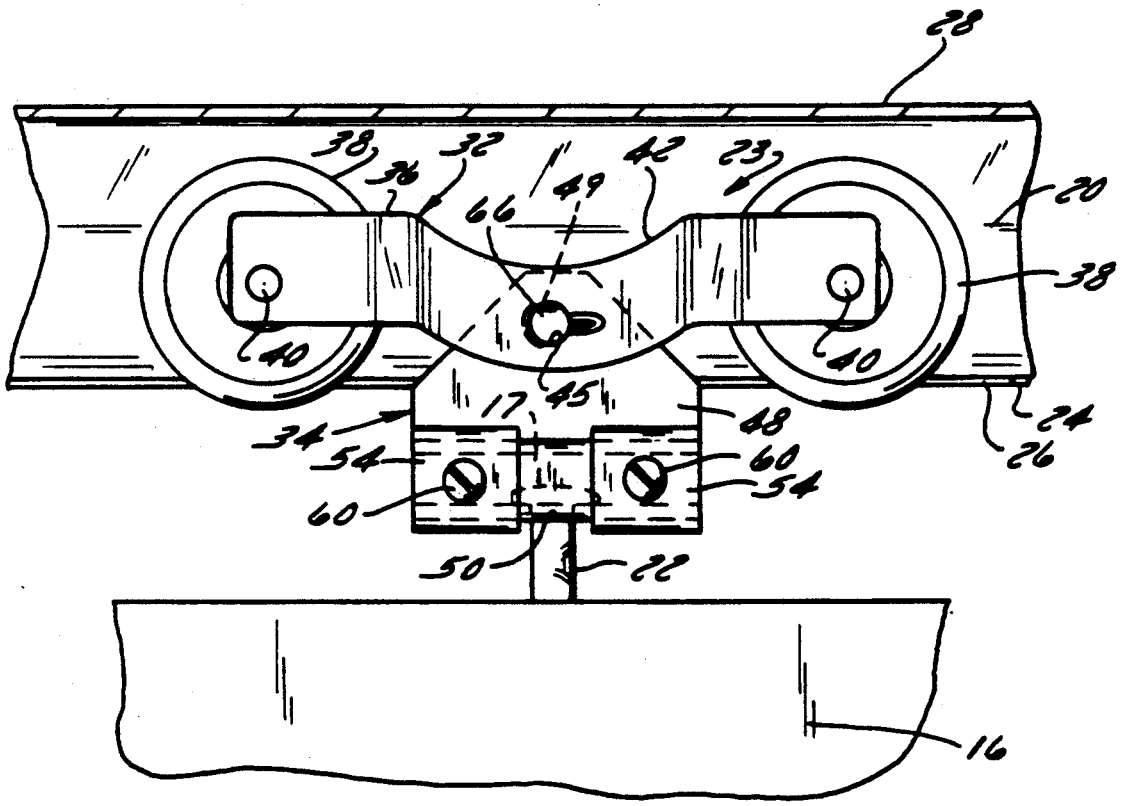
FIG. 6 is a side view of a trundle trolley showing the hanger bolt for the door.

One trundle trolley 23 is mounted in the track 20 for each hanger bolt 22 provided on the top of the door 16. The door 16 is positioned beneath the track assembly and initially leaned against the front wall 12 of the building. A trundle trolley is aligned with each of the hanger bolts 22. One end of the door is then raised to a height sufficient to align the head 17 of the hanger bolt 22 with the box sections 50 of the carriage 34 as seen in FIG. 5. The trundle trolley is then rolled into engagement with the hanger bolt 22 far enough for the bolt 22 to come into engagement with the edge of bracket 54. The second bracket 54 is then mounted on the other end of the box section 50 as seen in FIG. 6 to capture the hanger bolt 22 in the slot 51 in box sections 50.

Thus, it should be apparent that there has been provided in accordance with the present invention a trundle trolley for a sliding door track assembly that fully satisfies the aims and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A trundle trolley for supporting a sliding door for sliding movement in a track assembly mounted on a building, said trolley comprising a roller section and a carriage section mounted on said roller section, said carriage section including a pair of plates mounted in said roller section in abutting relation, each plate having a three sided box section suspended below said roller section with the edges of the box section spaced apart to form a slot, a hanger bolt mounted on the top of the door and being aligned in said slot in said carriage section and means mounted on said carriage section for locking said hanger bolt in said slot in said carriage section.

2. The trolley according to claim 1 including means for pivotally mounting said carriage section on said roller section.

3. A trundle trolley for supporting a door in a track assembly mounted on a building, the track assembly being in the form of a hollow elongate tube having a circular configuration with a slot along the bottom of the tube, said trolley comprising a roller section including a pair of parallel plates, having a roller mounted at each end, each roller handing an outer surface corresponding to the curvature of the elongate tube; and a carriage section including a pair of plates having an upper section mounted in abutting relation and aligned in the slot in the tube and a lower section having a slot along the lower edge of said carriage plates and a hanger bolt mounted in the top of the door and having a head, said bolt being mounted in said slot in said carriage section whereby said door is suspended from said carriage section.

4. The trolley according to claim 3 including means for retaining said hanger bolt in said slot in said carriage section.

5. The trolley according to claim 4 including means for pivotably mounting said carriage section in said roller section.

* * * * *